United States Patent [19]

Hayashi

[11] Patent Number: 4,486,157

[45] Date of Patent: Dec. 4, 1984

[54] RECIPROCATING COMPRESSOR

[75] Inventor: Yoshimasa Hayashi, Kamakura, Japan

[73] Assignee: Nissan Motor Co., Ltd., Yokohama, Japan

[21] Appl. No.: 449,738

[22] Filed: Dec. 14, 1982

[30] Foreign Application Priority Data

Dec. 16, 1981 [JP] Japan ..... 56-203149
Feb. 22, 1982 [JP] Japan ..... 57-27232

[51] Int. Cl.[3] ..... F04B 39/10; F01B 9/00

[52] U.S. Cl. ..... 417/534; 417/564; 92/138; 74/50

[58] Field of Search ..... 417/534, 535, 536, 564; 92/138; 74/50

[56] References Cited

U.S. PATENT DOCUMENTS

| | | | |
|---|---|---|---|
| 8,798 | 7/1879 | Schultz | 74/50 X |
| 1,213,917 | 1/1917 | Steinhauer et al. | 92/138 |
| 1,628,340 | 5/1927 | Thompson | 92/138 X |
| 1,820,883 | 8/1931 | Hueber | 417/534 X |
| 2,472,647 | 6/1949 | Covins | 92/138 X |
| 2,514,223 | 6/1950 | Covins | 92/138 X |
| 3,120,338 | 2/1964 | Rhodes | 417/566 X |
| 4,172,696 | 10/1979 | Gyory | 417/564 |

FOREIGN PATENT DOCUMENTS

| | | | |
|---|---|---|---|
| 460117 | 9/1913 | France | 417/534 |
| 562787 | 9/1923 | France | 417/535 |
| 1278114 | 10/1961 | France | 417/535 |
| 876602 | 9/1961 | United Kingdom . | |
| 1315156 | 4/1973 | United Kingdom . | |

*Primary Examiner*—William L. Freeh
*Assistant Examiner*—Paul F. Neils
*Attorney, Agent, or Firm*—Schwartz, Jeffery, Schwaab, Mack, Blumenthal & Koch

[57] ABSTRACT

A reciprocating compressor comprises a piston body reciprocally movably disposed within a cylinder housing and having first and second pistons which are coaxially aligned with each other. The first and second pistons define respectively first and second chambers within the cylinder housing. Intake and discharge valves are provided to allow therethrough a fluid to be sucked into and to be discharged out of each cylinder chamber, respectively. Additionally, the compressor is provided with a device for changing the rotary motion of a drive shaft into the reciprocating motion of the piston body. Accordingly, the compressor becomes small-sized and light in weight and is simplified in construction, thereby considerably reducing parts thereof.

9 Claims, 8 Drawing Figures

RECIPROCATING COMPRESSOR

BACKGROUND OF THE INVENTION

1. Field of the Invention

This invention relates to an improvement in a reciprocating compressor.

2. Description of the Prior Art

In connection with reciprocating compressors, a typical one is so constructed that two pistons are arranged side by side within a housing, and connected through connecting rods to a crankshaft. The rotatable connection of each connecting rod to the crankshaft is achieved through a bearing. Additionally, the crankshaft is rotatably supported by the housing through bearings. However, such a reciprocating compressor has encountered several drawbacks. Among these are that this type of compressor requires numerous bearings and is complicated and large-sized for the piston stroke volume.

SUMMARY OF THE INVENTION

A reciprocating compressor according to the present invention comprises a piston body reciprocally movably disposed within a cylinder housing and having first and second pistons which are coaxially aligned with each other. The first and second pistons define respectively first and second cylinder chambers within the cylinder housing. Intake and discharge valves are provided in operative connection with each cylinder chamber and adapted to allow a fluid to be sucked into and to be discharged out of the cylinder chamber, respectively. Additionally, this reciprocating compressor is provided with a device for changing the rotary motion of a drive shaft into reciprocating motion of the piston body. This changing device is preferably composed of a piston pin movably disposed within an elongate hole formed in the piston body and extending in a direction perpendicular to the axis of the piston. The piston pin is connected to the drive shaft and adapted to make a circular motion in accordance with the rotary motion of the drive shaft.

Accordingly, almost all the interior volume of the compressor housing serves as a space for piston stroke and therefore the compressor may be small in size and light in weight. Besides, the structure of the compressor is greatly simplified, thereby reducing the number of parts, particularly or bearings.

BRIEF DESCRIPTION OF THE DRAWINGS

The features and advantages of the reciprocating compressor according to the present invention will be more clearly appreciated from the following description taken in conjunction with the accompanying drawings in which like reference numerals designate like parts and elements, and in which.

DETAILED DESCRIPTION OF THE INVENTION

Figure 1:
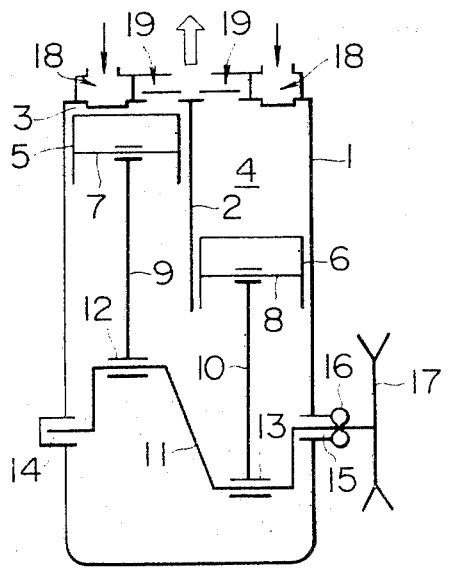
FIG. 1 PRIOR ART
FIG. 1 is a schematic illustration of a conventional reciprocating compressor.

Referring to FIG. 1, a conventional reciprocating compressor will be described along with its major shortcomings. The compressor is of the two-cylinder type and includes a housing 1 whose interior is divided into two cylinder chambers 3, 4. Two pistons 5, 6 are slidably disposed within the two cylinder chambers 3, 4, respectively, and connected through piston pins 7, 8 with connecting rods 9, 10, respectively. These connecting rods 9, 10 are in turn rotatably connected to a crankshaft 11 through bearing metals 12, 13 respectively. The crankshaft 11 is rotatably supported at its opposite ends by the housing 1 through bearings 14, 15, respectively. The crankshaft 11 is curved so that the phase difference between the two pistons 5, 6 is 180 degrees. One end portion of the crankshaft 11 projects out of the housing 1 through a sealing member 16, and is provided with a pulley 17. The reference numerals 18 and 19 denote, respectively, intake and discharge valves disposed for each cylinder chamber 3, 4.

With such a conventional reciprocating compressor, the two pistons 5, 6 make their reciprocal movement under the action of the crankshaft 11, maintaining a phase difference of 180 degrees therebetween. Accordingly, fluid to be compressed is sucked through the intake valve 18 into the cylinder chamber 3, 4 during descent movement of the piston 5, 6, while the fluid is compressed and discharged through the discharge valve 19 during ascent movement of the piston 5, 6.

However, difficulties have been encountered with such a conventional reciprocating compressor, in that since the two pistons 5, 6 are arranged side by side within the housing 1, a number of the bearings 12, 13, 14, 15 are necessary. This unavoidably makes the compressor itself complicated and large-sized for a relatively small displacement of each cylinder chamber 3, 4. Besides, since the connecting rods 9, 10 make a swinging motion during the ascent and descent movements of the pistons 5, 6, these pistons 5, 6 do not operate in accordance with a sine wave, thereby developing higher harmonic vibration.

Figure 2:
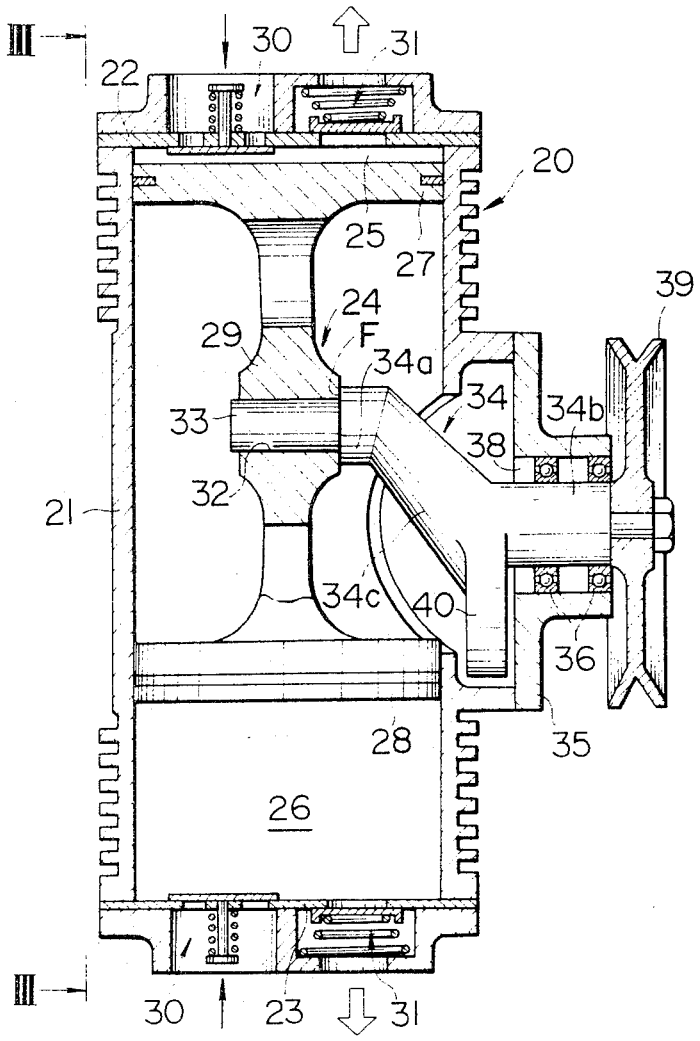
FIG. 2 is a vertical sectional view of a preferred embodiment of a reciprocating compressor in accordance with the present invention.
Figure 3:
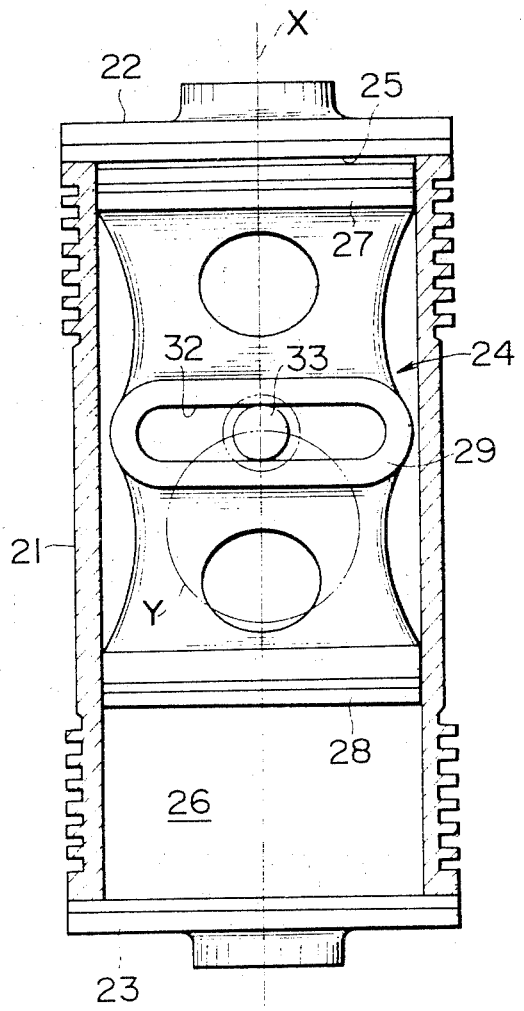
FIG. 3 is a front elevation, partly in section, of the compressor of FIG. 2, as viewed from the direction of arrows III—III of FIG. 2 in order to clearly show the shape of the piston body.

In view of the above description of the conventional reciprocating compressor, reference is now made to FIGS. 2 and 3, wherein a preferred embodiment of a reciprocating compressor of the present invention is illustrated by the reference numeral 20. The compressor 20 comprises a generally cylindrical cylinder housing 21 which is closed at its opposite ends by upper and lower closing or head plates 22, 23. A piston body 24 is slidably and reciprocally movably disposed within the cylinder housing 21 to define upper and lower cylinder chambers 25, 26. More specifically, the piston body 24 is provided with upper and lower pistons 27, 28 so that the upper cylinder chamber 25 is defined between the upper piston 27 and the upper closing plate 22 whereas the lower cylinder chamber 26 is defined between the lower piston 28 and the lower closing plate 23. The upper and lower pistons 27, 28 are securely interconnected by a connecting section 29 so that the pistons 27, 28 are located generally symmetrical with each other. Accordingly, both pistons 27, 28 are so arranged as to lie on a common axis X, i.e., that the axes of the both pistons 27, 28 are aligned with each other.

Each of the upper and lower closing plates 22, 23 is provided with intake and discharge valves 30, 31 which are arranged to open at the intake stroke and at the compression stroke of the piston 27, 28, respectively. The piston body connecting section 29 is provided with an elongate hole or slot 32 which extends in the direction perpendicular to the piston axis X. Disposed within the elongate hole 32 is a cylindrical piston pin 33 which is slidably movable in the direction of the length of the elongate hole 32. The elongate hole 32 is so formed that its length is slightly larger than the sum of the distance of a stroke of the piston 27, 28 and the diameter of the piston pin 33. The piston pin 33 is fixedly connected to an end section **34*a* of a drive shaft 34 whose other end section 34*b* is rotatably supported through a bearing 36 by a casing 35 which is fixed to the cylinder housing 21. The drive shaft 34 is bent to form an obliquely extended middle section 34*c* so that the piston pin 33 is circularly rotated as indicated by a phantom line Y in FIG. 3 around the axis of the supported end section 34*b* of the drive shaft 34 when the drive shaft 34 is driven. As shown, the drive shaft 34 is supported only at the end section 34*b* like a cantilever. Additionally, a sealing member 38 is disposed between the casing 35 and the drive shaft end section 34*b* and between the bearing 36 and the drive shaft middle section 34*c*, so that the bearing 36 is not subjected to the fluid which is supplied to the cylinder chambers 25, 26 and to be compressed. The supported end section 34*b* of the drive shaft 34 is formed with a projection (no numeral) on which a pulley 39 is fixedly mounted, so that the drive shaft 34 is rotated through the pulley 39 by a driving source (not shown) such as a motor. Projected from the drive shaft 34 is a balance arm or weight 40. Therefore, the rotary motion of the drive shaft 34 is changed into the reciprocating motion of the piston body 24 under co-operation of the circularly moved piston pin 33 and the elongate hole 32 formed in the piston body connecting section 29, i.e., under the slidable movement of the piston pin 33 within the elongate hole 32 in the lengthwise direction. As shown, a vertical end face of the piston body connecting section 29 is in contact with the vertical face F of the drive shaft end section 34*a* from which the piston pin 33 projects, thereby preventing the piston body 24** from rotation around the axis X.

The manner of operation of the thus arranged reciprocating compressor will be discussed hereinafter.

When the drive shaft 34 is rotated by the driving source, the piston pin 33 makes its circular motion as indicated by the phantom line Y. Then, the piston pin 33 slidably moves within the elongate hole 32 in the lengthwise direction, thereby causing the piston body 24 to move upwardly and downwardly so as to cause a reciprocating motion of the piston body 24. Since the phase difference between the pistons 27, 28 is 180 degrees, the pistons 27, 28 operate so that the lower piston 28 is in a compression stroke when the upper piston 27 is in an intake stroke. Under the reciprocating motion of the pistons 27, 28, the intake valve 30 opens to suck the fluid such as aqueous vapor, high temperature vapour, for example, of alcohol, or the like at the intake stroke of the piston 27, 28, and the thus sucked fluid is compressed at the compression stroke of the piston 27, 28 and then discharged by opening the discharge valve 31. In this case, the fluid to be compressed is slightly condensed within the interior of housing 21, and accordingly the thus condensed fluid serves to form a gas-tight seal and provide lubication between the inner surface of the cylinder housing 21 and the pistons 27, 28. Besides, by virtue of the sealing member 38, the bearing 36 is prevented from contacting the fluid to be compressed, thereby enabling use of lubricating oil such as grease.

It is to be noted that since the pistons 27, 28 of the above discussed reciprocating compressor 20 operate in simple harmonic motion and in accordance with a sine wave, they do not develop a higher harmonic component which is encountered with the piston connecting rods of a conventional reciprocating compressor, thus achieving considerably ideal operation of the compressor.

Besides, the piston body 24 is formed at its opposite axial ends with a pair of pistons 27, 28 through which the piston body is slidably supported within the cylinder housing 21, thereby achieving stable support of the piston body 24. As a result, it becomes possible to shorten the length of the head section of each piston 27, 28, thus reducing the friction between the piston body 24 and the inner wall surface of the cylinder housing 21. This allows a reduction in the driving force for the compressor.

Figure 4:
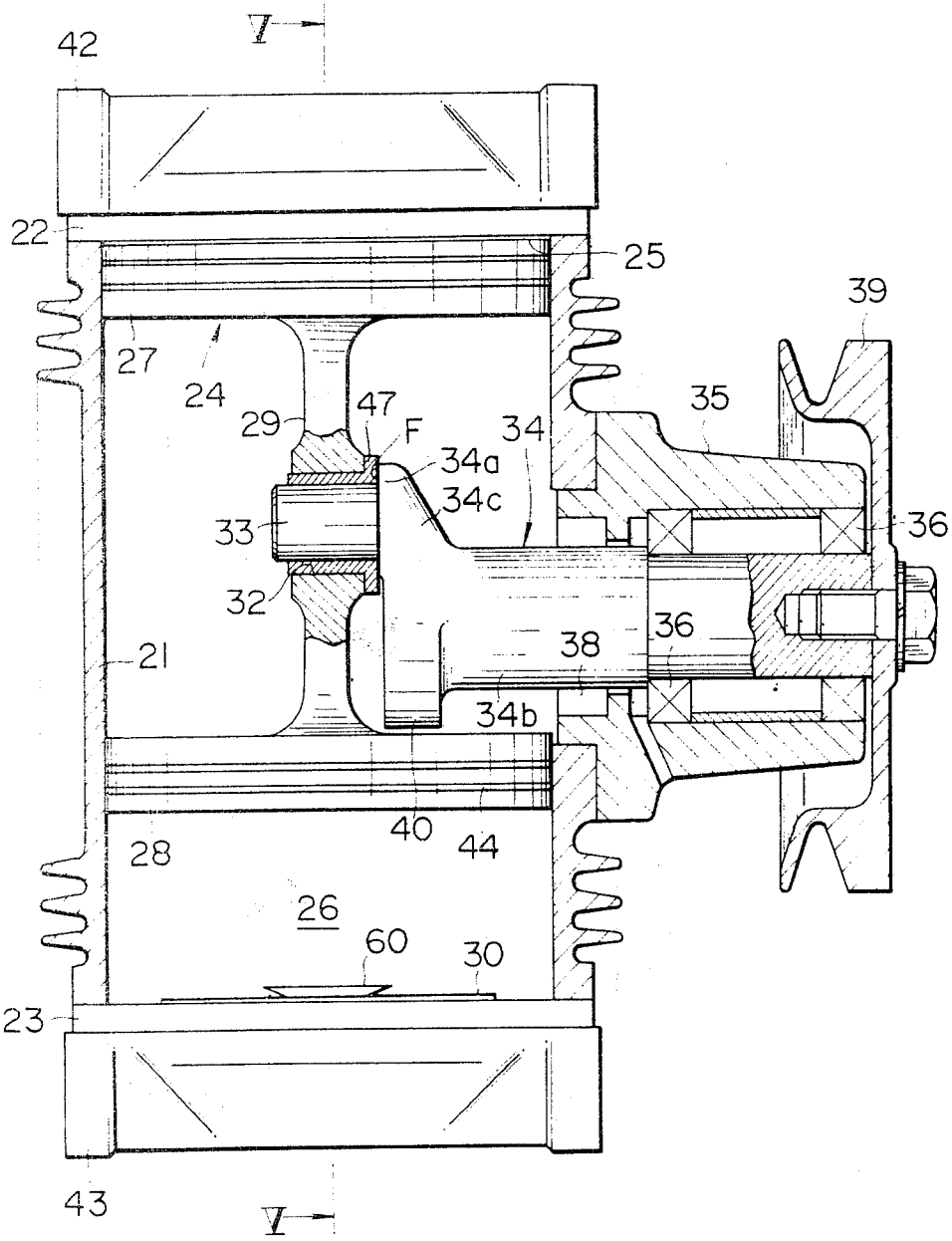
FIG. 4 is a vertical sectional view of another embodiment of the compressor according to the present invention.
Figure 5:
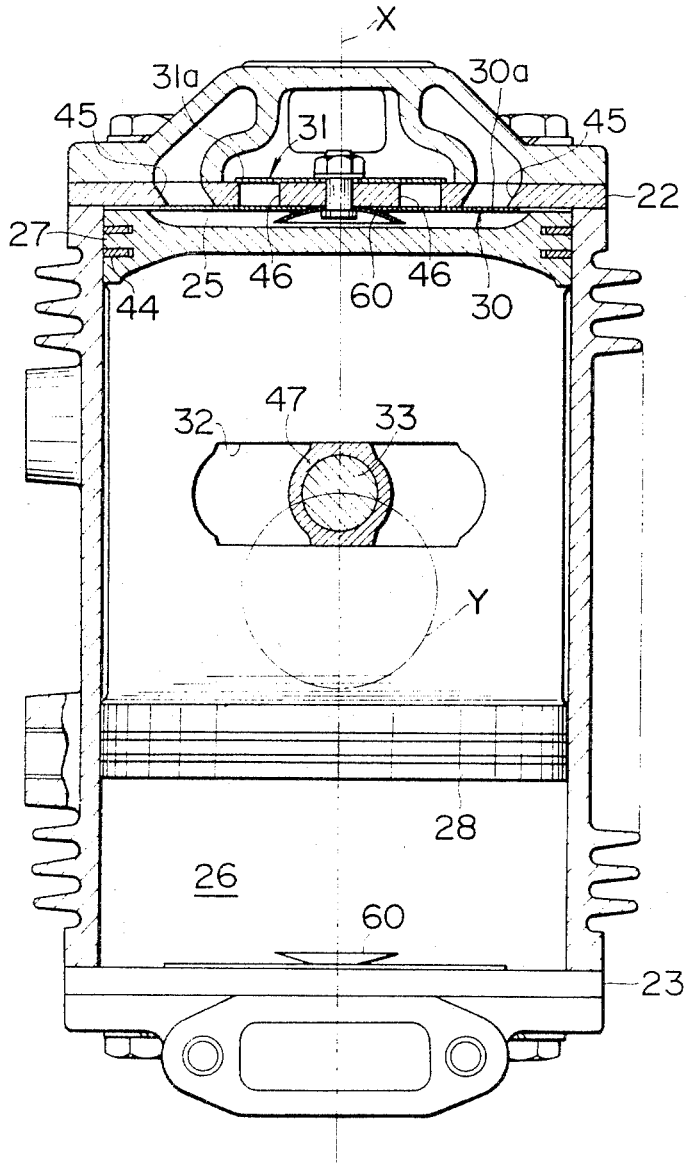
FIG. 5 is a vertical sectional view taken in the direction of arrows substantially along the line V—V of FIG. 4.

FIGS. 4 and 5 illustrate another embodiment of the reciprocating compressor according to the present invention, which is similar to the embodiment of FIGS. 2 and 3 except for the addition of a bushing 47 for the piston pin 33 and the particular structure of the intake and discharge valves 30, 31.

In this embodiment, the piston pin 33 is slidably disposed through the bushing 47 within the elongate hole 32. In addition, the opposite ends of the cylinder housing 21 are closed through the head plates 22, 23 by head covers 42, 43. The intake valve 30 includes a valve member **30*a* which is adapted to open and close an intake port 45, whereas the discharge valve 31 includes a valve member 31*a* which is adapted to open and close a discharge port 46. The numeral 44** denotes piston rings.

Figure 6:
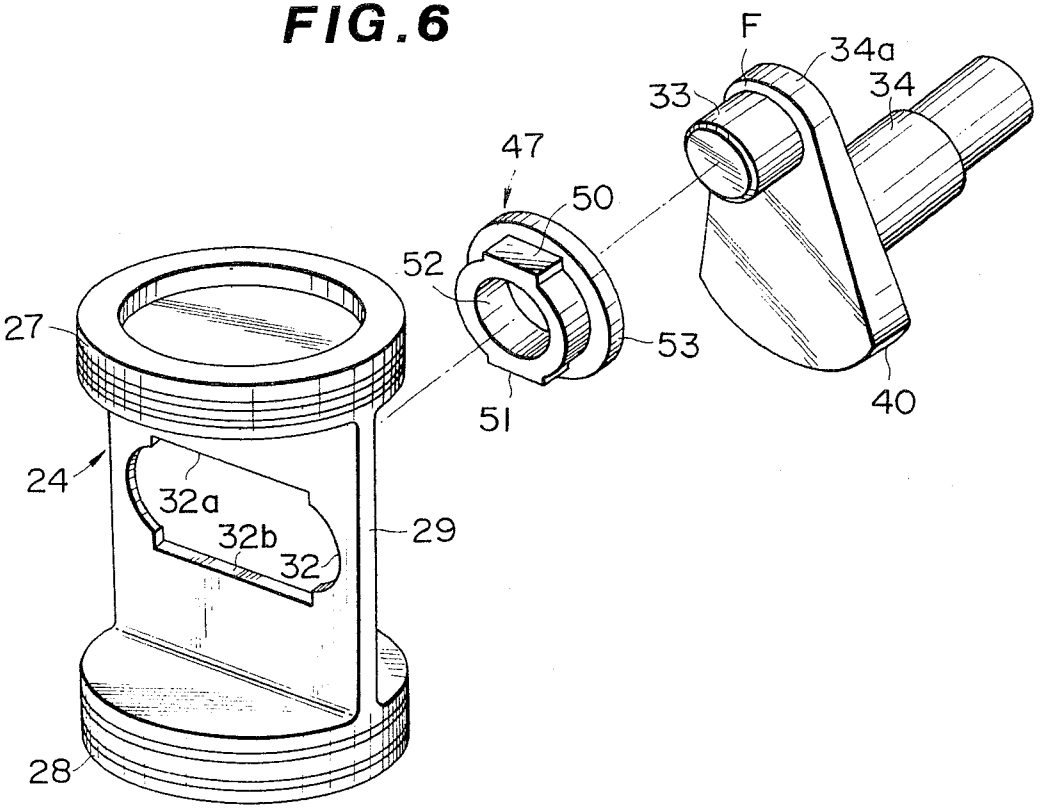
FIG. 6 is an exploded perspective view showing a piston body, a bushing, and a drive shaft used in the compressor of FIG. 4.

As best shown in FIG. 6, the bushing 47 includes a generally cylindrical section (no numeral) which is located within the elongated hole 32 and is formed with a cylindrical hole 52 in which the piston pin 33 is rotatably disposed. The cylindrical section of the bushing 47 is formed with upper and lower flat portions 50, 51 which are parallel with each other. The respective surfaces of the upper and lower flat portions 50, 51 are in slidable contact with the upper and lower straight elongated inner wall surfaces **32*a*, 32*b* of the elongate hole 32 which surfaces are parallel with each other and extend in the direction perpendicular to the axis of the pistons 27, 28. The bushing 47 further includes an annular flange section 53 which is coaxial and integral with the bushing cylindrical section. The flange section 53 is slidably interposed between the surface of the piston body connecting section 29 and the flat end face F of the drive shaft end section 34*a*. It will be understood that this bushing 47 prevents the surface of the piston pin 33 from direct contact with the elongate hole inner wall surfaces 32***a*, 32*b*, thereby effectively reducing sliding friction developed between the piston pin surface and the elongate hole inner wall surfaces 32*a*, 32*b*. This greatly saves driving force. In case the piston body 24 is made of light alloy, the bushing 47 is made of Teflon or phosphor bronze. While the contacting portions 50, 51 of the bushing 47 have been shown and described as being flat, they 50, 51 may have a curved surface having a larger radius of curvature which surface is in contact with the inner wall surface 32*a*, 32*b* of the piston body elongate hole 32.

Figure 7:
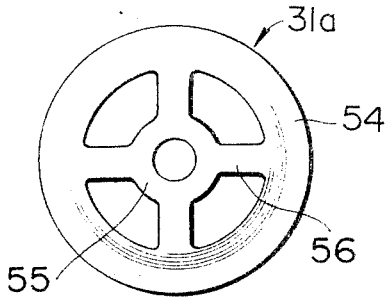
FIG. 7 is a plan view of a valve member of a discharge valve used in the compressor of FIG. 4.
Figure 8:
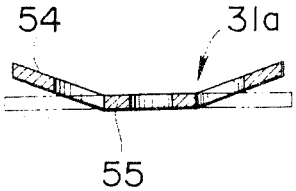
FIG. 8 is a sectional view of the valve member of FIG. 7, illustrating the operation of the valve member.

FIG. 7 shows in detail the valve member 31*a* of the discharge valve 31, which valve member 31*a* is of the annular disc type and adapted to open and close the discharge port 46 formed in the head plate 22, 23 by an outer peripheral portion 54 of the valve member 31*a*. The operation of the valve member 31*a* is shown in FIG. 8 wherein the valve member 31*a* deforms from its closing state indicated in phantom into its open state indicated by solid lines. It will be understood that, in this embodiment, arm sections 56 interconnecting the outer peripheral section 54 and a central annular section 55 are resilient. The valve member 30*a* of the intake valve 30 is also similarly configurated, and its deflection is restricted by an umbrella-shaped member 60 shown in FIG. 5.

While the bushing 47 has been used to improve sliding movement of the piston pin 33 on the inner wall surfaces of the piston body elongate hole 32 in the embodiment of FIGS. 4 to 8, it will be understood that a ball bearing or a roller bearing may be used in place of the above-mentioned bushing 47.

As will be appreciated from the above, according to the present invention, almost all the interior of the compressor serves as a space for piston stroke and therefore the compressor becomes small-sized and light in weight. Furthermore, the compressor is simplified in construction, thereby considerably reducing the number of parts, particularly the number of bearings. In addition, the pistons reciprocally move in accordance with a sine wave, thus preventing generation of a higher harmonic frequency. In the above-embodiments, since the seal member is located inside of the bearing, it becomes possible to use, as a fluid to be compressed, aqueous vapour or alcohol vapour whose condensed liquid achieves lubrication.

What is claimed is:

1. A reciprocating compressor comprising:

a cylinder housing;

a drive shaft rotatably mounted in said housing;

a piston body reciprocally movably disposed within said cylinder housing and having first and second pistons which are coaxially aligned with each other, and a connecting section interconnecting said first and second pistons, said first and second pistons respectively defining first and second cylinder chambers within said cylindrical housing;

intake the discharge valves disposed in operative connection with each cylinder chamber and respectively adapted to allow therethrough a fluid to be sucked into and to be discharged out of the cylinder chamber;

means for changing rotary motion of said drive shaft into reciprocating motion of said piston body said changing means including means defining an elongate hole in a middle section of said piston body connecting section, said elongate hole extending in a direction perpendicular to the axis of said pistons, and a piston pin movably disposed within said elongate hole and connected to said drive shaft, said piston pin being adapted to follow a circular path in accordance with the rotary motion of said drive shaft; and a bushing rotatably mounted on said piston pin and slidably engaged with said elongate hole, said bushing including a generally annular section which is slidable on an inner wall surface of said elongate hole and formed with a cylindrical opening within which said piston pin is rotatably disposed, and an annular flange section integral and coaxial with said annular section, said flange section being located between a surface of said piston body connecting section and a face of an end section of said drive shaft to which end section said piston pin is integrally connected, said bushing annular section being formed with two flat surfaces which are parallel with each other, said two flat surfaces being in slidable contact with two straight elongated inner wall surfaces, respectively, of said elongate hole, said two straight elongated inner wall surfaces being parallel with each other and extending in a direction perpendicular to the axis of said pistons.

2. A reciprocating compressor as claimed in claim 1, further comprising first and second closing plates which are adapted to securely close the opposite ends of said cylinder housing, said first closing plate being located facing to said first piston to define said first cylinder chamber therebetween, said second closing plate being located facing to said second piston to define said second cylinder chamber therebetween.

3. A reciprocating compressor as claimed in claim 2, wherein each of said first and second closing plates is formed with an intake port through which the fluid is sucked into the cylinder chamber, and a discharge port through which the fluid is discharged out of the cylinder chamber, in which said intake and discharge valves are adapted to open and close said intake and discharge ports, respectively.

4. A reciprocating compressor as claimed in claim 1, wherein said discharge valve includes a disc-type valve member which is secured at its central section to a closing plate adapted to securely close each of the opposite ends of said cylinder housing, said valve member being adapted to open and close a discharge port formed through said closing plate through which discharge port the fluid is discharged out of the cylinder chamber.

5. A reciprocating compressor as claimed in claim 4, wherein said valve member includes an annular outer peripheral section located to close said discharge port, and radially extending arm sections interconnecting said central section and said outer peripheral section, said arm sections being resilient.

6. A reciprocating compressor as claimed in claim 1, wherein said drive shaft has one end section which is rotatably supported and wherein an axis of said piston pin is parallel with and separate from an axis of the supported end section of said drive shaft, said piston pin being adapted to move in the direction of elongation of said hole upon being moved in a circular motion around the axis of said drive shaft supported end section in accordance with the rotary motion of said drive shaft supported end section.

7. A reciprocating compressor as claimed in claim 6, further comprising a casing fixedly connected to said cylinder housing, said casing rotatably supporting the end section of said drive shaft through a bearing located between said housing and said drive shaft supported end section.

8. A reciprocating compressor as claimed in claim 7, further comprising a seal member disposed between said casing and said drive shaft supported end section to maintain a fluid-tight seal therebetween, said seal member being located inside of said bearing.

9. A reciprocating compressor as claimed in claim 8, further comprising a drive pulley fixedly connected to the supported end section of said drive shaft, said drive pulley being adapted to be rotated by a driving source.

* * * * *